United States Patent [19]

Clawson et al.

[11] 4,091,917

[45] May 30, 1978

[54] CONTACT LENS CASE

[76] Inventors: Burrell E. Clawson; James Weigl, both of 2241 Chicago, Riverside, Calif. 92507

[21] Appl. No.: 745,623

[22] Filed: Nov. 29, 1976

[51] Int. Cl.[2] ..... A45C 11/04; B65D 85/54; B08B 3/04; B65D 41/00

[52] U.S. Cl. ..... 206/5.1; 134/137; 220/301

[58] Field of Search ..... 206/5.1; 215/222, 227, 215/320, 354; 220/301; 134/137

[56] References Cited

U.S. PATENT DOCUMENTS

| | | | |
|---|---|---|---|
| 2,968,421 | 1/1961 | Eshbaugh | 220/301 |
| 3,822,780 | 7/1974 | Ulmer et al. | 206/5.1 |

*Primary Examiner*—William T. Dixson, Jr.
*Attorney, Agent, or Firm*—Gordon L. Peterson

[57] ABSTRACT

A contact lens case comprising a container and a receptacle adapted to receive the container. The container includes a container body and a cover with the cover being releasably attachable to the container body. The cover has a surface tension area within the interior of the container. The surface tension area is adapted to have the contact lens adhered thereto by surface tension when the container has been drained of storage fluid and when the lens is made to contact the surface tension area by squeezing the container. When the container is then opened by raising the cover, the contact lens adheres to the surface tension area and is automatically removed from the interior of the container.

21 Claims, 8 Drawing Figures

CONTACT LENS CASE

BACKGROUND OF THE INVENTION

Contact lenses are typically put into a contact lens case when they are not in use. An important purpose of the case is to protect the contact lenses.

Although there are many different kinds of contact lens cases, one of the most significant is the type which allows the lenses to be immersed in a liquid solution within the case. The liquid solution may, for example, contain a mild detergent for removing various contaminants from the lenses.

Cases of this latter type may include a container for holding the lenses and a receptacle for carrying the container. This type of lens case is shown by way of example in U.S. Pat. Nos. 3,822,780 and 3,880,278.

One problem with a case of this type is that the lenses are relatively difficult to remove from the case without contaminating or damaging the lenses. For example, the lenses may be damaged or contaminated by rubbing or picking at the lenses with fingertips or other objects. In addition, the case is capable of scratching or otherwise damaging the lenses, particularly if the lens case leaks dry or is used as a dry storage container.

SUMMARY OF THE INVENTION

The present invention provides a contact lens case which materially facilitates removal of the lenses from the case. The lens case of this invention provides substantial protection for the contact lenses and materially reduces the likelihood of scratching the lenses. Either hard or soft lenses may be stored in the case.

The present invention provides a container which includes a container body, a cover, and means for releasably attaching the cover and container body together. The container has an interior for containing the contact lenses and for exposing the contact lens to a liquid solution.

One feature of the invention is that, when the cover is removed from the container body, the contact lens is automatically removed from the interior of the container by the cover. This automatic withdrawal feature eliminates the need for the user to insert his finger into a recess in the container in an effort to remove the contact lens. This can be advantageously accomplished by providing a surface tension surface or area on the cover with the surface tension surface being within the interior of the container when the releasable attaching means releasably joins the cover and the container body together. The surface tension surface can be of various configurations; however, it must be of a configuration which will permit the contact lens to be adhered thereto by surface tension.

To further facilitate removal of the contact lens from the surface tension surface, this surface preferably projects axially beyond the cover. In other words, the surface tension surface holds the contact lens, in effect, on a pedestal for ease of removal.

Holding means is provided within the interior of the container for holding the contact lens closely adjacent the surface tension surface. It is used to assure the formation of adequate surface tension between the contact lens and the surface tension surface. Although this holding means may be of various different configurations, it should provide for less surface tension between it and the contact lens than exists between the contact lens and the surface tension surface if the contact lens is to be withdrawn from the interior of the container by removal of the cover. This may be accomplished, for example, by providing holding means which includes a plurality of posts.

The posts are also of advantage even if the present invention is practiced without a surface tension surface. In this event, the relatively small area of contact between the posts and the contact lens provides only a minimal amount of surface tension with the result that the lens can be easily removed from the posts by touching it with a wet finger.

The surface tension surface preferably covers less area than the contact lens which is to be adhered thereto so that a peripheral region of the contact lens is exposed. This permits removal of the contact lens by the rolling of a finger of the user beneath such peripheral region or lightly grasping the periphery of the lens with two fingers. Although the surface tension surface may be convex, or of other configurations, in a preferred embodiment, the surface tension surface is concave and defines a recess.

Another important feature of the invention is that the container is constructed of resilient, deformable material. The material of the container is also preferably soft. These factors cooperate to reduce the likelihood of scratching the lenses on the container.

Another advantage of a resilient container is that it can be squeezed slightly prior to opening the cover to assure that the holding means urges the lens into contact with the surface tension surface so that the surface tension is strong enough to hold the lens on the surface tension surface. Preferably, the container and the holding means are all made of resilient, deformable material.

In order to have surface tension, it is, of course, necessary to have a liquid associated with the container. Although the container may be used alone, it is preferred to provide a receptacle of relatively hard material which is adapted to receive the container and a liquid solution which cleans the lenses. The container has appropriate openings to permit contact between the liquid solution and the lens and to permit the liquid to be drained from the container in order to obtain the desired amount of surface tension. The posts and the surface tension surface are spaced sufficiently so that the liquid solution can contact all surfaces of the lens.

Although various different receptacle constructions can be used, a receptacle may include a receptacle body defining at least a major portion of an open-ended chamber and a closure for closing the open end of the chamber. The chamber is adapted to receive the container.

Another feature of the invention is the manner in which the closure is mounted on the container. According to this invention, the closure is mounted for pivotal movement on the container about a pivot axis which is capable of being displaced laterally relative to the container. Releasable locking means is provided on the closure and the receptacle body. The locking means is responsive to pivotal movement of the closure relative to the receptacle body and to lateral displacement of said pivot axis relative to the container for releasably locking the closure and the receptacle body together. One advantage of this construction is that the ability of the closure mounting structure to move laterally facilitates locking and releasing of the locking means.

Although the closure can be mounted on the container in various different ways to provide for lateral displacement of the closure, this can advantageously be accomplished by using mounting means which includes a projection of resilient, deformable material with the projection being received by the closure so as to mount the closure for pivotal movement and lateral displacement. The projection can be formed integrally with the container, if desired. Of course, the features of this invention relating to the closure can be used together with, or independently of, the other features of this invention.

The invention, together with further features and advantages thereof, may best be understood by reference to the following description taken in connection with the accompanying illustrative drawing.

DESCRIPTION OF THE PREFERRED EMBODIMENT

Figure 1:
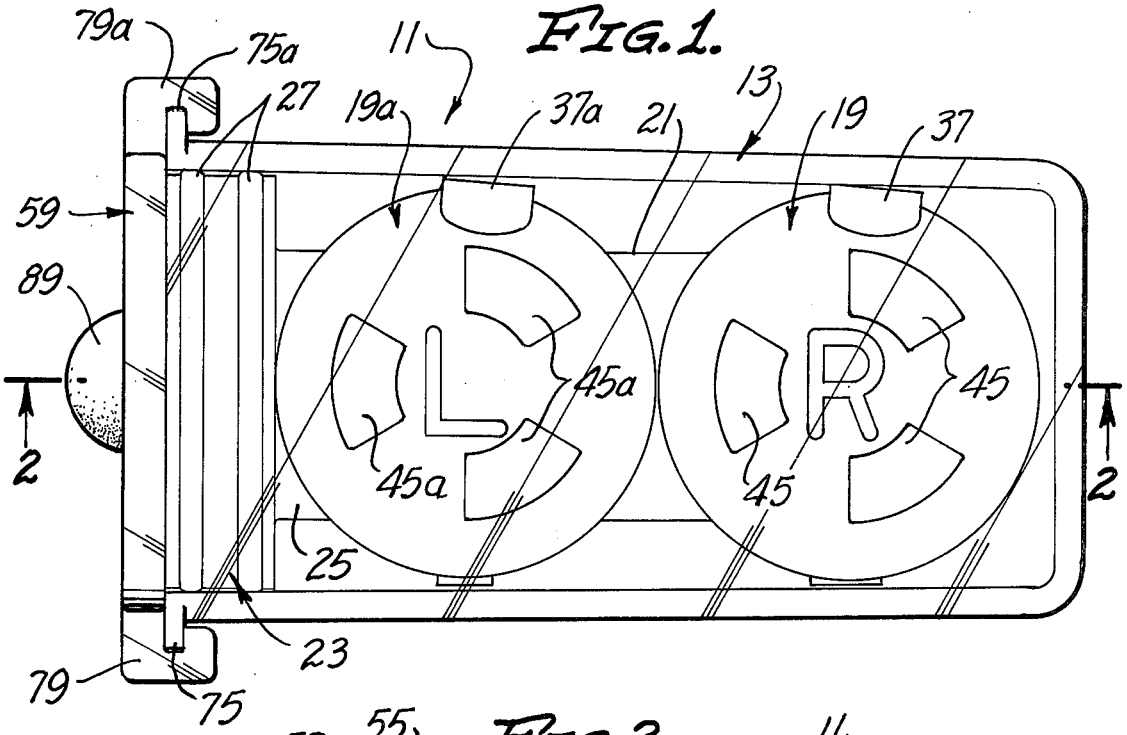
FIG. 1 is a top plan view of a contact lens case constructed in accordance with the teachings of this invention.
Figure 2:
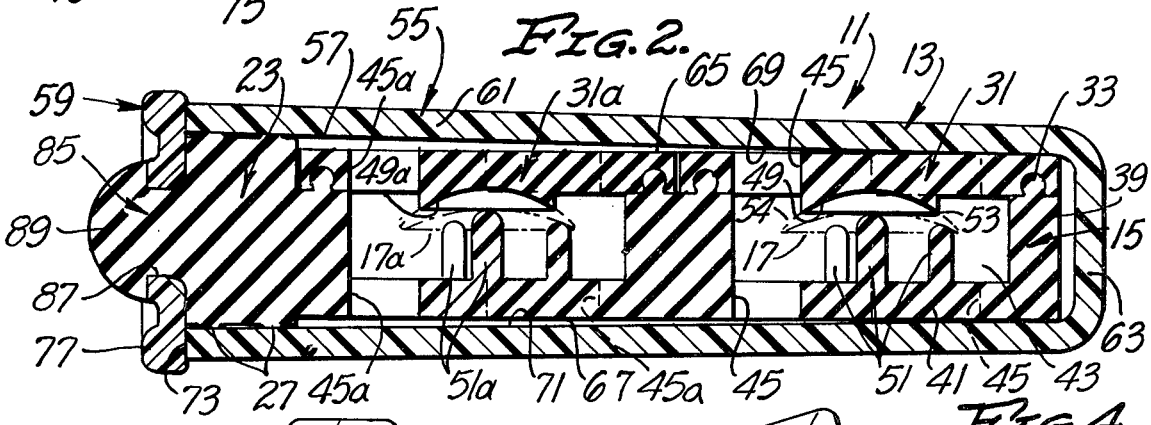
FIG. 2 is a sectional view taken generally along line 2—2 of FIG. 1.

FIGS. 1 and 2 show a contact lens case 11 which generally comprises a receptacle 13 and a container 15. The container 15 is adapted to hold a pair of contact lenses 17 and 17*a* which, for purposes of this description, are assumed to be identical, although this is not required. The container 15, in the embodiment illustrated, is integrally molded from a soft, resilient, deformable material such as silicone rubber or thermoplastic rubber.

The container 15 includes two identical, side-by-side container segments 19 and 19*a* which are integrally interconnected by a web 21 and which are adapted to contain the contact lenses 17 and 17*a*, respectively. The container 15 has a seal 23 integrally joined to the container segment 19*a* by a web 25. The seal 23 includes two circumscribing, axially spaced sealing ribs 27. A vent passage 28 (FIG. 5) is provided in the seal 23.

As the container segments 19 and 19*a* are identical, only the container segment 19 is described in detail herein, and corresponding parts are designated by corresponding reference numerals followed by the letter "*a*." The container segment 19 includes a container body 29 (FIG. 6), a cover 31, and attaching means in the form of an annular tongue 33 on the upper edge of the container body 29 and a cooperating groove 35 on the cover 31 for receiving the tongue. In addition, the attaching means also includes an integral, flexible strap 37 integrally joining the container body 29 and the cover 31 and forming a hinge connection therebetween. Various different means can be used to releasably attach the cover 31 to the container body 29, and the construction shown is purely illustrative. The strap 37 can be eliminated, if desired.

The container body 29 includes a peripheral wall 39 and a bottom wall 41. The container body 29 defines a major portion of a cavity 43 within the container segment 19. A plurality of apertures 45 are formed in the bottom wall 41 and the cover 31, respectively.

The contact lens 17 is retained between a surface tension surface 49 on the cover 31 and holding means in the form of resilient, deformable posts 51 formed integrally with the bottom wall 41 and projecting perpendicularly upwardly therefrom. One purpose of the posts 51 is to support the contact lens 17 closely adjacent the surface tension surface 49 while assuring that there is less surface tension between the posts and the contact lens than exists between the contact lens and the surface tension surface 49. The number, configuration, and pattern of the posts 51 shown herein are purely illustrative. In the embodiment illustrated, four of the posts 51 are provided, with one of the posts 51 being located axially in the cavity 43 and being longer and thicker than the others. The other three posts are equally spaced from each other and equally spaced from the central post.

The surface tension surface 49 may be of any configuration which will provide adequate surface tension for withdrawing the contact lens 17 from the cavity 43 when the cover 31 is removed. In the embodiment illustrated, the surface tension surface 49 is convex and defines a recess opening axially in the cavity 43. More specifically, the surface tension surface 49 in the embodiment illustrated is part spherical and is coaxial with the central post 51 and the cavity 43. The surface tension surface 49 has a peripheral edge 53 which extends axially beyond any other region of the cover 31. A peripheral region 54 of the lens 17 lies radially outwardly of the edge 53. The posts 51 and the surface tension surface 49 holds the lens 17 so that there is a clearance space along the surfaces of the lens.

The receptacle 13 includes a receptacle body 55 defining a chamber 57 and a closure 59. In order to protect the resilient, deformable container 15, the receptacle 13 is preferably rigid and may be constructed, for example, of a rigid, transparent plastic material. The receptacle 13 can be of various configurations; however, in the embodiment illustrated, the receptacle body 55 includes a peripheral wall 61 and an end wall 63 integral with the peripheral wall. The chamber 57 can be of various configurations and dimensions; however, preferably it is sized and configured to slidably receive the container 15. The container 15 has substantially flat, parallel upper and lower surfaces 65 and 67 (FIG. 2), respectively, and the seal 23 and the ribs 27 are generally rectangular in transverse cross-section. The chamber 57 is rectangular in cross section. In the embodiment illustrated, opposite inner surfaces 69 and 71 (FIG. 2) of the peripheral wall 61 taper slightly toward each other as they extend toward the end wall 63.

The peripheral wall 61 terminates in an edge 73. A pair of flanges 75 and 75*a* is formed integrally with the peripheral wall 61. The flanges 75 and 75*a* project in opposite directions at the edge 73.

Figure 3:
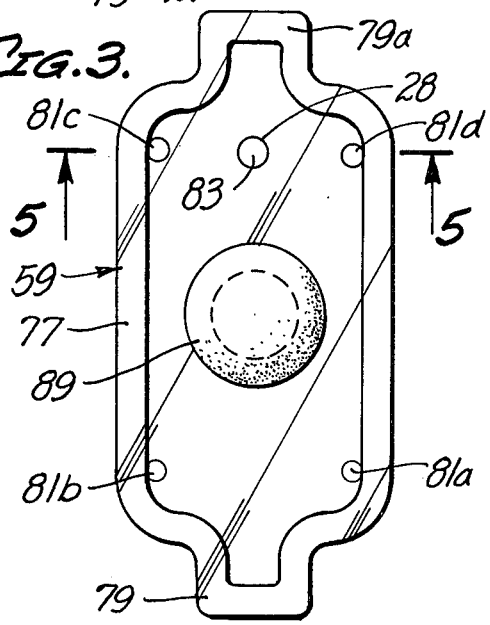
FIG. 3 is an end elevational view of the lens case.
Figure 4:
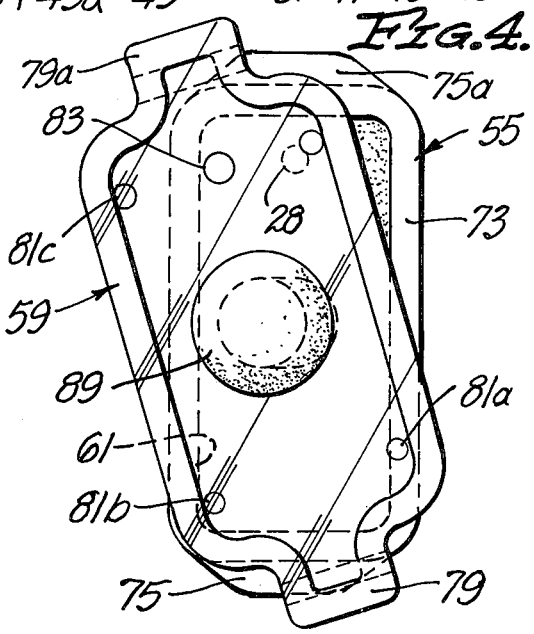
FIG. 4 is an end elevational view of the lens case similar to FIG. 3 with the closure of the receptacle being rotated toward a releasing position.
Figure 5:
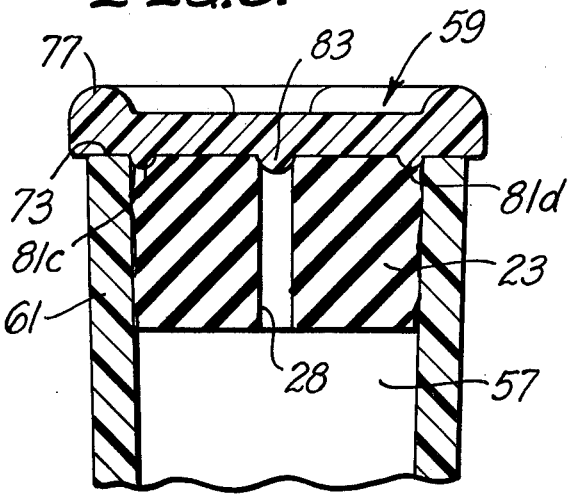
FIG. 5 is an enlarged fragmentary sectional view taken generally along line 5—5 of FIG. 3.

In the embodiment illustrated, the closure 59 is in the form of a generally flat plate which is sized to close the open end of the chamber 57. The closure 59 has an integral peripheral strengthening rib 77 which extends completely around the closure. Identical U-shaped lugs 79 and 79*a* are formed integrally at the opposite ends of the closure 59. Four integral, rigid detents 81*a*, 81*b*, 81*d* extend inwardly from the inner surface of the closure 59 adjacent the four corners of the closure (FIGS. 3–5). A projection 83 extends inwardly from the inner surface of the closure 59 (FIGS. 3–5).

The closure 59 is mounted on the container 15 for pivotal movement and lateral displacement relative to the container. In the embodiment illustrated, this is accomplished by providing a resilient, deformable projection 85 integral with the seal 23. The closure 59 has an opening 87 through which the projection 85 extends. The projection 85 includes an enlarged head 89 for retaining the closure 59 on the container 15.

As shown in FIGS. 1 and 2, the container 15 is adapted to be snugly received within the chamber 57 of the receptacle 13. The ribs 27 snugly engage the inner surface of the peripheral wall 61 to retain the outer end of the container against movement relative to the receptacle 13. The U-shaped lugs 79 and 79*a* receive the flanges 75 and 75*a*, respectively, to hold the closure 59 tightly over the open end of the chamber 57. In addition, the rigid detents 81*a*–81*d* engage the inner surface of the peripheral wall 61 closely adjacent the edge 73 to releasably retain the closure 59 and the receptacle body 55 against rotation and/or sliding relative to each other. In other words, this maintains the lugs 79 and 79*a* in locking engagement with the flanges 75 and 75*a*, respectively. In this position, the inner surface of the closure 59 is held against the edge 73 as shown in FIGS. 2 and 5. The projection 83 is received within the outer end of the vent passage 28 to close the vent passage.

The contact lenses 17 and 17*a* are retained within the container segments 19 and 19*a*, respectively. Specifically, the contact lens 17 is held closely adjacent the surface tension surface 49 by the posts 51, and the contact lens 17*a* is similarly retained by the surface tension surface 49*a* and the posts 51*a*. An appropriate liquid solution containing a detergent or other suitable agents is provided within the receptacle 13. This solution can enter and leave the container segments 19 and 19*a* by way of the apertures 45 and 45*a*. The seal 23 seals the open end of the chamber 57 to prevent loss of the liquid solution.

To remove the container 15 from the receptacle 13, it is first necessary to unlock the closure 59. This is accomplished by rotating the closure 59 in either direction relative to the receptacle body 55 to disengage one of the lugs 79 and 79*a* from the associated flanges 75 and 75*a*.

Assuming that the closure 59 is rotated counterclockwise from the position shown in FIG. 3 toward the position shown in FIG. 4, then the detent 81*b* will tend to maintain its engagement with the inner surface of the peripheral wall 61 thereby tending to provide the pivot axis, by virtue of such engagement, about which the closure 59 rotates. As rotation is initiated, the detent 81*c* is forced over the edge 73, and as the closure 59 is rotated counterclockwise beyond the position shown in FIG. 4, the detent 81*a* moves over the edge 73. However, the detents 81*c* and 81*a* move over the edge 73 in sequence, rather than simultaneously and this materially facilitates opening of the closure by allowing a large detent height and thus a very positive detent without having extremely high stresses in the closure 59.

In order that the closure 59 can pivot about an axis in the vicinity of the detent 81*b*, it is necessary that the central region of the closure 59 move laterally. With this invention, this lateral movement of the central region of the closure 59 is accommodated by the resilient deformation of the projection 85. Specifically, the projection 85 deforms laterally to the left (as viewed in FIG. 4) to allow the above-described pivotal movement of the cover 59. The projection 85 also serves as a convenient one-piece attachment device for the closure.

The exact manner of opening the closure 59 will vary depending upon the forces exerted on the closure, and the opening procedure described above with reference to FIGS. 3 and 4 is illustrative. However, in normal use, the closure 59 will pivot about an axis lying between the projection 85 and one end of the closure. Of course, the closure can also be opened by pivoting it clockwise from the position shown in FIG. 3.

Pivoting of the closure 59 also removes the projection 83 from the outer end of the vent passage 28. The container 15 is then removed from the chamber 57 by pulling outwardly on the closure 59. The vent passage 28 allows air to enter the chamber 57 to facilitate withdrawal of the container from the chamber. The container 15 can be inserted into the receptacle and the receptacle can be closed by the closure 59 by reversing the procedure described above.

Figure 6:
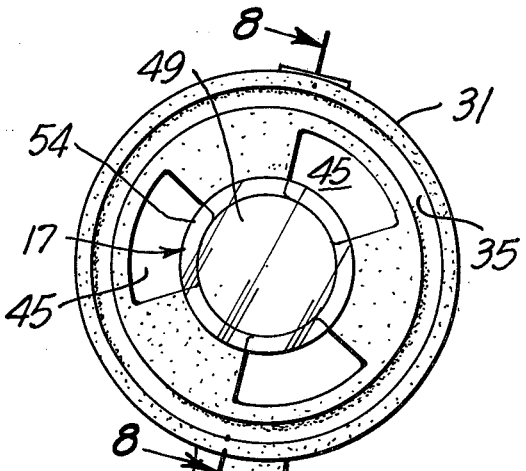
FIG. 6 is a top plan view of the container with one of the covers to expose a portion of the interior of the container.
Figure 6:
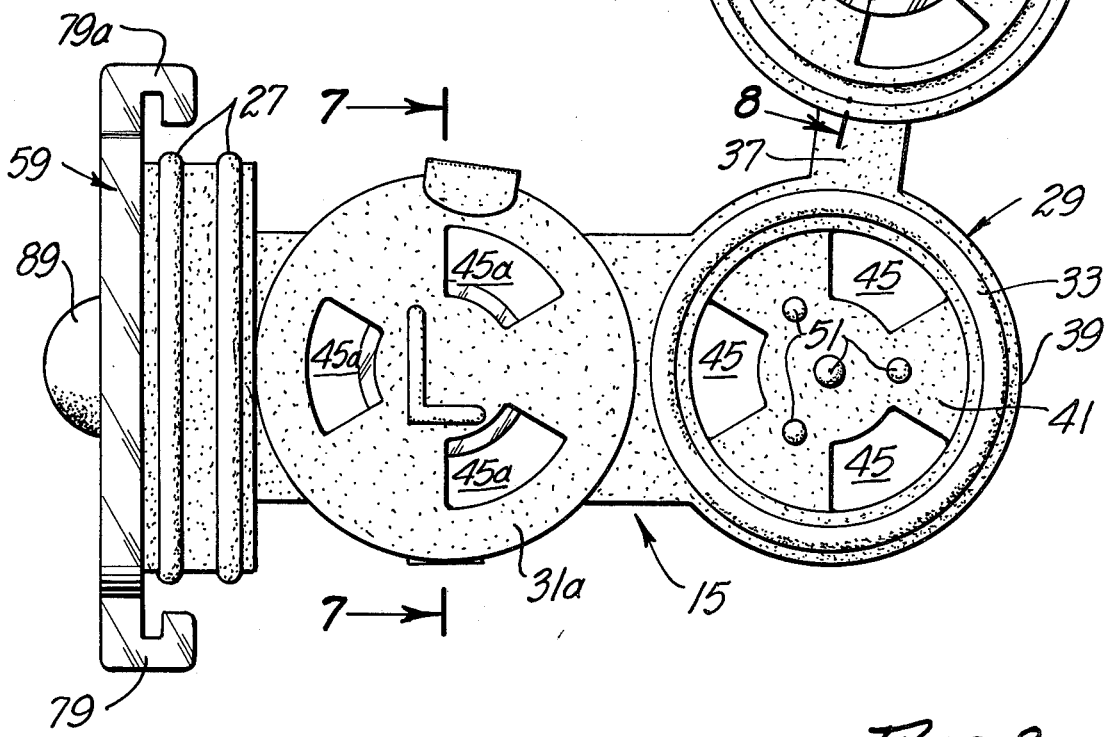
Figure 7:
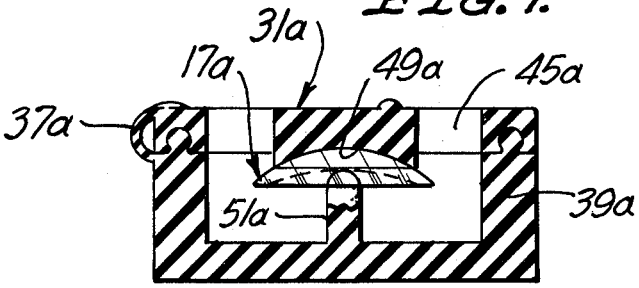
FIG. 7 is a sectional view taken generally along line 7—7 of FIG. 6.

As the container 15 is being removed from the chamber 57, the liquid solution can drain out of the container through the apertures 45 and 45*a*. However, enough of the liquid solution remains in the container to provide the surface tension required by this invention. With the container 15 removed from the chamber 57, as shown in FIG. 6, the container segments 19 and 19*a* can be squeezed across their thicknesses to cause the posts 51 and 51*a* to urge the contact lenses 17 and 17*a* snugly against the surface tension surfaces 49 and 49*a*. This establishes substantial surface tension between the contact lenses 17 and 17*a* and the associated surface tension surfaces 49 and 49*a*. The area of engagement between the ends of the posts 51 and the contact lens 17 is less than the area of engagement between the contact lens and the surface tension surface 49. Accordingly, there is less surface tension tending to maintain the contact lens on the posts 51 than there is tending to hold the contact lens on the surface tension surface 49.

Figure 8:
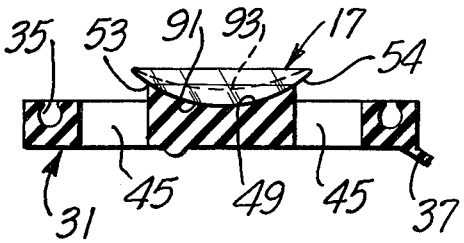
FIG. 8 is a sectional view taken generally along line 8—8 of FIG. 6.

The cover 31 can then be removed from the container body 29 to the position shown in FIG. 6 and when this occurs, the contact lens 17 adheres to the surface tension surface 49 and is withdrawn from the cavity 43. With the surface tension surface 49 inverted to the position shown in FIGS. 6 and 8, the contact lens is, in effect, held on a pedestal above the surrounding regions of the cover 31. Accordingly, it is an easy matter for the user to place his finger beneath the peripheral region 54 of the convex surface 91 of the contact lens 17 and roll it in such a manner as to roll the contact lens 17 onto his finger. Alternatively, the peripheral region 54 of the contact lens 17 can be grasped to remove the contact lens from the surface tension surface 49. In either event, only the convex surface 91 of the contact lens 17 is touched and not the concave surface 93 which is ultimately to be in contact with the eye. Of course, the contact lens 17*a* may be similarly removed from the surface tension surface 49*a*.

Although an exemplary embodiment of the invention has been shown and described, many changes, modifications and substitutions may be made by one having ordinary skill in the art without necessarily departing from the spirit and scope of this invention.

We claim:

1. A contact lens case for at least one contact lens comprising:

a container including a container body, a cover and means for releasably attaching said cover and container body together, said container having an interior for containing the contact lens and exposing the contact lens to a liquid solution;

a surface tension surface on said cover, said surface tension surface being within the interior of the container when said releasable attaching means releasably joins said cover and said container body together, said surface tension surface being adapted to releasably retain the contact lens on the surface tension surface by surface tension;

means on said container for holding the contact lens closely adjacent the surface tension surface; and said releasable attaching means being releasable to permit said cover and said container body to be at least partially separated from each other whereby the contact lens can be releasably retained by surface tension on the surface tension surface and removed from the interior of the container to facilitate removal of the contact lens from the surface tension surface.

2. A contact lens case as defined in claim 1 wherein said container has a wall opposite said cover and at least one of said wall and said cover is resiliently deformable in a direction to enable said wall and said cover to be relatively advanced toward each other to cause the holding means to urge the contact lens against the surface tension surface to assure that the contact lens is seated on the surface tension surface.

3. A contact lens case as defined in claim 1 wherein said container body and said cover are constructed of resilient, deformable material.

4. A contact lens case as defined in claim 1 wherein said surface tension surface projects axially beyond the cover to thereby facilitate removal of the contact lens from the surface tension surface.

5. A contact lens case as defined in claim 1 including a receptacle having a chamber therein, said chamber being adapted to receive the container.

6. A contact lens case as defined in claim 5 wherein said receptacle includes a receptacle body defining at least a major portion of the chamber and a closure, means for mounting the closure on said container for pivotal movement about a pivot axis which is capable of being displaced laterally relative to said container and releasable locking means on said closure and said receptacle body responsive to pivotal movement of the closure relative to the receptacle body and to lateral displacement of the closure relative to the receptacle body for releasably locking the closure and the receptacle body together.

7. A contact lens case as defined in claim 5 wherein said receptacle includes a receptacle body defining at least a major portion of the chamber and a closure, said chamber having an open end, said receptacle including means for releasably attaching the closure to the receptacle body to permit the closure to close the open end of the chamber, said container includes means for sealing the open end of the chamber, said container having a vent passage extending through the sealing means, and means on said closure for closing said vent passage when the closure closes the open end of the chamber.

8. A contact lens case as defined in claim 5 wherein said container has a wall opposite said cover and at least one of said wall and said cover is resiliently deformable in a direction to enable said wall and said cover to be relatively advanced toward each other to cause the holding means to urge the contact lens against the surface tension surface to assure that the contact lens is held on the surface tension surface, said holding means includes a plurality of resilient, deformable posts, said surface tension surface defines a recess adapted to partially receive the contact lens with a peripheral region of the contact lens being exposed to facilitate removal of the contact lens from the surface tension surface.

9. A contact lens case as defined in claim 1 wherein said holding means includes at least one resilient, deformable member engageable with the contact lens over a lesser area than the area of engagement between the contact lens and the surface tension surface.

10. A contact lens case as defined in claim 1 wherein said holding means includes a plurality of resilient, deformable posts.

11. A contact lens case as defined in claim 1 wherein said surface tension surface defines a recess adapted to partially receive the contact lens with a peripheral region of the contact lens being exposed to facilitate removal of the contact lens from the surface tension surface.

12. A contact lens case for at least one contact lens comprising:

a container including a plurality of resilient container sections and means for releasably attaching said container sections together, said container having an interior for containing the contact lens and exposing the lens to a liquid solution;

a plurality of resilient, deformable posts on at least one of the container sections, each of said posts terminating in an end within the interior of the container at least when said releasable attaching means releasably attaches said sections together, the ends of said posts being adapted to support the contact lens thereon;

means within the interior of said container for holding the contact lens closely adjacent the ends of the posts; and said releasable attaching means being releasable to permit said one container section and the remainder of the container to be at least partially separated from each other to expose the contact lens.

13. A contact lens case as defined in claim 12 wherein said holding means includes surface means on a second of said container sections for defining a recess in the interior of said container, said recess being adapted to at least partially receive the contact lens.

14. A contact lens case as defined in claim 1 including a receptacle having a chamber therein, said chamber being adapted to receive the container, said receptacle includes a receptacle body defining at least a major portion of the chambers and a closure, said chamber having an open end, means for attaching the cover to said container for movement relative thereto, and said receptacle including means for releasably attaching the closure to the receptacle body to permit the closure to close the open end of the chamber.

15. A contact lens case for at least one contact lens comprising:

a container including a plurality of container sections and means for releasably attaching said sections together, said container having an interior for containing the contact lens and exposing the lens to a liquid solution;

a receptacle including a receptacle body defining at least a major portion of an open-ended chamber and a closure for closing the open end of said chamber, said chamber being adapted to receive said container;

means for mounting the closure on said container for pivotal movement about a pivot axis which is capable of being displaced laterally relative to said container; and releasable locking means on said closure and said receptacle body responsive to pivotal movement of the closure relative to the receptacle body and to lateral displacement of the pivot axis relative to the container for releasably locking the closure and the receptacle body together.

16. A contact lens case as defined in claim 15 wherein said mounting means includes resilient, deformable material which is resiliently deformable to allow said lateral displacement of the closure relative to the receptacle body.

17. A contact lens case as defined in claim 15 wherein said mounting means includes a projection integral with said container, said projection and said container being constructed of resilient, deformable material, said projection being received by said closure to mount said closure for pivotal movement and said lateral displacement.

18. A contact lens case as defined in claim 15 wherein said locking means includes at least one lug on one of said closure and said receptacle body and a cooperating flange on the other of said closure and said receptacle body for holding the closure on the receptacle body and at least one detent on at least one of the closure and the receptacle body for releasably retaining the closure and the receptacle body against relative pivotal movement.

19. A contact lens case as defined in claim 18 wherein said mounting means includes a projection of resilient, deformable material, said projection being received by said closure to mount said closure for said pivotal movement and said lateral displacement.

20. A contact lens case as defined in claim 15 wherein said container includes means for sealing the open end of said chamber, said container having a vent passage extending through the sealing means, and means on said closure for closing said vent passage when the closure closes the open end of the chamber.

21. A contact lens case as defined in claim 15 wherein the locking means is responsive to pivotal movement of the closure relative to the receptacle body about a second pivot axis which lies intermediate one end of said closure and the first-mentioned pivot axis.

* * * * *